US005575593A

United States Patent [19]

Raaf

[11] Patent Number: 5,575,593

[45] Date of Patent: Nov. 19, 1996

[54] METHOD AND APPARATUS FOR INSTALLING A HELICAL PIER WITH PRESSURIZED GROUTING

[75] Inventor: David B. Raaf, Independence, Mo.

[73] Assignee: Atlas Systems, Inc., Independence, Mo.

[21] Appl. No.: 273,210

[22] Filed: Jul. 11, 1994

[51] Int. Cl.[6] ..... F02D 5/44

[52] U.S. Cl. ..... 405/237; 405/232; 405/244; 405/233

[58] Field of Search ..... 405/232, 233, 405/237, 241, 244, 249, 236, 266, 230, 229

[56] References Cited

U.S. PATENT DOCUMENTS

| | | | |
|---|---|---|---|
| 1,093,262 | 4/1914 | Goldsborough | 405/230 |
| 1,270,659 | 6/1918 | Ravier . | |
| 2,412,239 | 12/1946 | Weber | 405/236 |
| 2,924,948 | 2/1960 | Mueller | 405/236 |
| 3,243,962 | 4/1966 | Ratliff . | |
| 3,738,071 | 6/1973 | Finsterwalder . | |
| 3,786,641 | 1/1974 | Turzillo . | |
| 3,802,208 | 4/1974 | Granholm et al. . | |
| 3,842,608 | 10/1974 | Turzillo | 405/236 |
| 3,962,879 | 6/1976 | Tvrzillo | 405/236 |
| 3,999,391 | 12/1976 | Meredith . | |
| 4,533,279 | 8/1985 | vanden Elzen et al. | 405/241 X |
| 4,634,319 | 1/1987 | May . | |
| 4,659,259 | 4/1987 | Reed et al. . | |
| 4,678,373 | 7/1987 | Lagenbach, Jr. | 405/233 X |
| 4,718,791 | 1/1988 | Weatherby . | |
| 4,800,700 | 1/1989 | May . | |
| 4,830,544 | 5/1989 | Anderson, Jr. . | |
| 4,854,782 | 8/1989 | May . | |
| 4,907,916 | 3/1990 | Hartman | 405/233 X |
| 5,011,336 | 4/1991 | Hamilton et al. . | |
| 5,120,163 | 6/1992 | Holdeman et al. . | |
| 5,139,368 | 8/1992 | Hamilton et al. . | |
| 5,171,107 | 12/1992 | Hamilton et al. . | |
| 5,213,448 | 5/1993 | Seider et al. . | |

FOREIGN PATENT DOCUMENTS

| | | | |
|---|---|---|---|
| 2545572 | 4/1977 | Germany | 405/237 |
| 85028 | 5/1984 | Japan | 405/233 |

OTHER PUBLICATIONS

"Correlations for Design of Laterally Loaded Piles on Soft Clay" by Hudson Matlock, The U. of Texas at Austin, Offshore Technology Conference, Houston, Texas, Apr. 22–24, 1970.

"Analysis of Laterally Loaded Piles in Sand" by Lymon C. Reese et al., Offshore Technology Conference, Houston, Texas, May 6–8, 1974.

"Soil Response for Laterally Loaded Piles", by Kenneth E. Tand.

"Lateral Resistance of Piles in Cohesive Soils", by Bengt B. Broms, Journal of the Soil Mechanics and Foundations Division, Mar., 1964.

"Lateral Response of Piles", by William R. Spillers and Robert D. Stoll, Journal of the Soil Mechanics and Foundations Division, Nov. 1964.

"Behavior of Laterally Loaded Piles: II—Pile Groups", by Harry G. Poulos, Journal of the Soil Mechanics and Foundations Division, May, 1971.

"Earth Forces on Anchors".

*Primary Examiner*—Tamara L. Graysay
*Assistant Examiner*—Frederick L. Lagman
*Attorney, Agent, or Firm*—Kokjer, Kircher, Bowman & Johnson

[57] ABSTRACT

A method and apparatus used to increase the stiffness characteristic of soil to improve its ability to support a structures and to provide a tie-back anchoring force. The apparatus includes an anchor having helixes thereon is rotated into the ground. The helical anchor is hollow and includes multiple perforated holes along its length and about its perimeter. Once, the anchor is drilled into the ground, pressurized grout is injected therein. The grout is forced through the helical anchor and out through the perforated holes. The grout fills any voids along the sides of the anchor and stiffens the surrounding soil. Once the grout hardens, it may be used in a tie-back application or to support new and old construction or the like. The grout surrounding the anchor increases its lateral support and prevents deflection thereof.

29 Claims, 3 Drawing Sheets

METHOD AND APPARATUS FOR INSTALLING A HELICAL PIER WITH PRESSURIZED GROUTING

BACKGROUND OF THE INVENTION

1. Field of the Invention

The present invention relates in general to a helical pier which utilizes pressurized grouting to stabilize a section of soil to increase the helical pier's supporting characteristics, such as when used with old construction, with new construction, in tie-back applications and the like.

2. Description of the Related Art

In the past, systems have been proposed in which piers, pilings, and the like are anchored into the earth and used to support various structures, such as walls, bridges, and buildings. One system has been proposed (U.S. Pat. No. 3,999,391) in which a tie-back anchor is drilled into non-excavated, undisturbed earth and used to support upstanding shoring walls through a plurality of tension cables. The anchor is formed from a hollow tubular element having helical flighting elements thereon for pulling the anchor into place. Multiple load transfer pins extend inwardly through the tube walls. Once in place, loose cables with bushings locked on the lower ends thereof are lowered into the hollow tube. The cables are staggered such that the bushings are distributed along the anchor's length. Next, the tube is filled with grout and, once hardened, serves to transfer tension loading from the cables to the load transfer pins and the tube.

However, tie-back anchors of this type were ineffective in regions of earth which were uncompressed or otherwise naturally unstable. Further, anchors of this type necessitated the use of non-corrosive (e.g., galvanized) tubing to prevent deterioration of the anchor.

An alternative system has been proposed (U.S. Pat. No. 3,738,071) in which a pre-stressed tension anchor is constructed by initially drilling a bore hole into the ground. A tension member, including steel bars arranged in a radially symmetrical manner and separated by spacers is lowered into the bore hole. Next, the hole is filled with a cement glue and once hardened, the cement glue and tension member form an anchor. A similar tie-back anchor has been proposed (U.S. Pat. No. 4,718,791) having a unitary hollow casing connected to a drill. Pre-stressing steel tendon is inserted within the casing and a lost bit is affixed to a bottom end of the casing. The drill and casing are then positioned in the desired location and the casing is rotated into the ground by the drill while fluid, such as air or water, is used to remove the soil from the region surrounding the casing as the casing is advanced. Once the casing has been drilled to the desired depth, and a cavity has been formed thereabout, the bit is released and grout is pumped through the casing into the cavity. Then the casing is removed from the hole before the grout hardens, thereby leaving a bit within the grout and affixed to the pre-stressing steel tendon.

In two alternative systems (U.S. Pat. Nos. 1,270,659 and 4,830,544) tie-back anchors are provided which utilize tubing to inject grout into the ground and which leave tubing in the hole with the grout. The '544 patent discloses a tie-rod anchor which is inserted into a previously formed hole. The tie-rod includes a tube which is separated into five distinct sections coupled to one another with fittings. A valve fitting initially directs grout to a flexible bag formed about an uppermost outlet fitting to initially fill the bag and seal off the top of the hole. Once the hole is sealed, the valve fitting opens and allows a remainder of the grout to be injected into the hole through outlet fittings. In the '544 patent, a cable is mounted beside the tube and secured to the grout to enable the anchor to be coupled to a desired structure.

The system of the '659 patent is used to reinforce retaining walls, such as used in harbors and wharfs. In the system of the '659 patent, a piling is driven into the earth and filled with concrete. The piling is tubular in structure, perforated, and includes an open bottom end. The tube may be inserted into the ground by inserting a boring tool through the tube. As the boring tool makes the hole, the tube is forced into place thereafter with the earth being withdrawn at the top of the tube.

However, the tubing of the '544 and '659 patents do not serve as the primary anchoring force. Further, the systems of the '791, '544, '071, and '659 patents require that earth be excavated out of the way before concrete is injected. Also, the prior art systems require multiple steps to insert and utilize the anchors. The systems of the '659, '791, '544, and '071 patents require separate drilling tools to bore the hole in which the anchor is inserted. Further, the systems of the '791, '544, and '071 patents utilize cables imbedded within concrete to provide the primary anchoring force.

While the system of the '391 patent provides an anchor which is sinkable without a separate drill, this anchor relies exclusively on the integrity of the earth and flightings upon the anchor. Further, the anchor of the '391 patent requires a complex internal cable assembly projecting from the anchor to provide tension loading, which must be installed after the anchor is sunk.

Systems have been proposed for sinking underpinnings to support new and old structures, such as buildings, bridges, patios, and the like. Exemplary systems are disclosed in U.S. Pat. Nos. 4,634,319, 4,800,700, 4,854,782, 5,011,336, 5,120,163, 5,139,368, 5,171,107, and 5,213,448. These systems sink pilings or helical underpinnings along the foundation of an existing structure which has settled. The pilings and underpinnings are sunk to bedrock or a load-bearing strata which is able to provide sufficient support throughout the life of the structure. Once sunk, the pilings or underpinnings are used as bases to support an equal number of hydraulic jacks which include rams fastened to the foundation through brackets. The rams are used to raise the building. The building is affixed at this raised height by securing the brackets to the pilings or underpinnings.

However, when the pilings or helical underpinnings are used in soils having a weak load-bearing capacity, they must be sunk to a substantial depth. Thus, a significant amount of materials and labor are needed to sink multiple piers. To reduce the necessary depth, the piling and helix diameters must be increased. However, this requires additional driving force.

Further, when loads are placed on the piling or helical underpinning, the uppermost end thereof sinks slightly under the weight of the structure. This phenomenon is commonly referred to as deflection and results when the piling laterally bends or bows underground as a load is applied. Lateral deflection varies depending upon the amount of lateral support offered by the soil. When drilling a helical underpinning into the ground, the helixes thereon disturb and disrupt the soil surrounding the underpinning. Thus, helical underpinnings may experience substantial lateral deflection. Such deflect is undesirable since it reduces the load-bearing capacity of the underpinning and requires an allowance therefore when calculating the level at which to secure the foundation to the underpinning. Also, each underpinning will experience a different amount of deflection, and thus provides varying amounts of support for the foundation.

Moreover, piers supporting new and existing structures and tie-back applications frequently experience large lateral forces which are caused by earthquakes, lateral earth pressures, and the like. The piers or pilings must be able to resist these lateral forces. In some areas, building codes require that the piles are capable of resisting a lateral force equal to 10% of the applied axial load. Piles serving as tie-backs to support retaining walls, abutments, rigid frame bridges, locking structures, and the like, also frequently experience high lateral forces. These lateral forces may be resulted from lateral earth pressures acting upon the retaining structure or from differential fluid pressures acting upon the locking structure. Additional lateral forces may result from horizontal thrust loads acting on abutments of fixed or hinged arched bridges. The lateral support capacity of such piles varies depending upon the cohesiveness of the soil with more cohesive soil providing more lateral support.

Additionally, once a conventional pier or helical underpinning is sunk into the ground, during rain storms, rainwater collects around the top of the shaft. The outside surface of shaft serves as conduit to direct this water downward about its perimeter. As the rainwater migrates down the shaft, it soaks into the surrounding soil and reduces the cohesion characteristics between the pier/underpinnings and the surrounding soil. The migrating rain water also travels along the surface of helixes, further interfering with the transfer of loads between the helixes and the soil. Also, certain gypsiferous soils and the like, include a composition having water soluble materials (salt and the like) therein which, when dry, contribute substantially to the load bearing capacity of the soil. As the rainwater leaches through this soil proximate the helixes, these soluble materials are displaced with the water. Hence, as the rainwater soaks outward, certain soils afford a lesser load bearing structural value when wet.

Hereafter, tie-back anchors and underpinnings are collectively referred to as "pier columns". Also, hereafter new and old construction supported by underpinnings and structures held by tie-backs are collectively referred to as "structures".

The need remains within the industry to provide an improved anchoring assembly and method of use therefor to overcome the disadvantages heretofore experienced. The present invention is intended to satisfy this need.

SUMMARY OF THE INVENTION

An object of the present invention is to provide a helical anchor which stabilizes a region of ground in order to support new and old construction and to serve as a tie-back anchor.

Another object of the present invention is to provide a helical anchor which is hollow and which includes holes in its periphery to enable pressurized grouting to be injected through the anchor and to surround a substantial portion of the outside of the anchor.

Another object of the present invention is to provide a helical anchor which utilizes pressurized grouting to fill any voids along the outside of the anchor.

Another object of the present invention is to provide a helical anchor which utilizes pressurized grouting injected through the anchor to stabilize earth surrounding the anchor by injecting the grouting under pressure through holes along the outside of the anchor.

It is another object of the present invention to provide an anchor assembly which facilitates easy installation in areas of limited access.

It is a further object of the present invention to increase an underpinning or a tie-back anchoring force for a given diameter anchor.

It is another object of the present invention to prevent the degradation, by rainwater, of a soil's load bearing capacity by preventing the migration of rainwater along the underpinning.

These and other objects of the present invention will become clear in view of the detailed descriptions set forth hereafter.

In summary, the invention includes an apparatus and method by which an anchor having helixes thereon is rotated into the ground. The helical anchor is hollow and includes multiple perforated holes along its length and about its perimeter. Once, the anchor is drilled into the ground, pressurized grout is injected therein. The grout is forced through the helical anchor and out through the perforated holes. The grout fills any voids along the sides of the anchor, stiffens the surrounding soil and prevents migration of rainwater along the anchor. Once the grout hardens, it may be used in a tie-back application or to support new and old construction or the like. The grout surrounding the anchor increases its lateral support and prevents deflection thereof.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Prior to explaining the preferred embodiments of the present invention, it is necessary to explain generally the forces exerted upon a pier-type anchor or underpinning, with or without helixes thereon.

Interacting Forces Between Anchors and Earth

Pier or piling type anchors undergo a plurality of forces when installed in tie-back and underpinning applications, for new and old construction. In these applications, the effectiveness of the pier is primarily dictated by (1) the diameter and length of the pier, (2) the number, placement and diameter of the helixes along the pier (if used), (3) the type/characteristics or "stiffness" of the soil into which the pier is sunk, and (4) the soil's load bearing capacity. The soil stiffness refers to the soil's cohesion and friction characteristics which greatly influence the anchor's effectiveness. These characteristics control the amount of lateral deflection undergone by the pier when placed under a load. The soil's load bearing capacity strongly effects the pier's ultimate anchoring force, as an underpinning or a tie-back.

Figure 1:
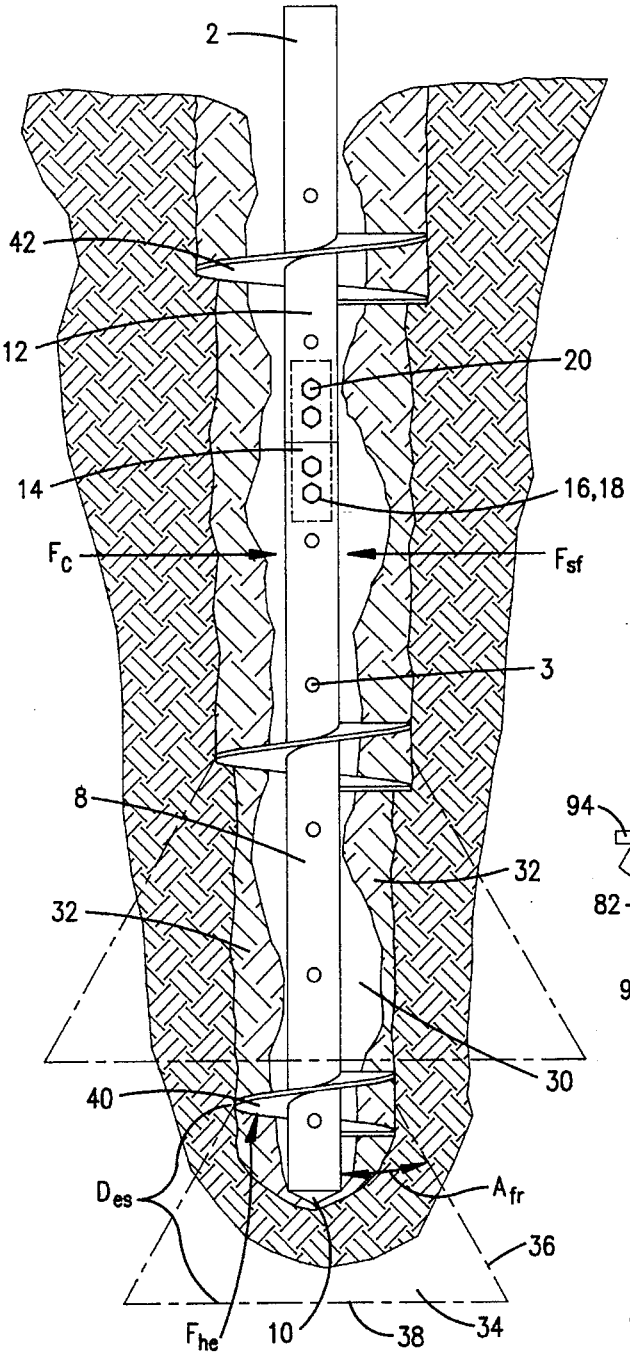
FIG. 1 illustrates a side sectional view of a helical anchor according to the present invention, as used with new and old construction, sunk into the ground with loose soil and voids there around.

FIG. 1 illustrates a pier column 2 which has been sunk into the ground and will ultimately experience a downward load, such as from new or old construction. As the pier column 2 is drilled into the ground, the helixes 4 thereon rotate through the soil immediately adjacent the pier column 2. Once the pier column 2 is sunk, the soil interacts therewith to resist lateral and longitudinal movement of the pier. Specifically, the soil exerts skin friction forces $F_{sf}$ and cohesion forces $F_c$ upon the outer periphery of the pier column 2. These forces act upon the pier column 2 to resist movement. Thus, these forces are applicable in tie-back and underpinning applications.

Further, the helixes 4 upon the pier column 2 further experience a helix force $F_{he}$ in a vertical direction which is exerted by soil within an effective soil region 34 (outlined by a dashed line). The effective soil region 34 projects away from the corresponding helix 4 along a side border 36 running at an angle $A_{fr}$ with respect to a longitudinal axis of the pier column 2. The angle $A_{fr}$ is substantially equal to the soil's friction angle. The friction angle varies dependent upon the friction coefficient of the soil which is dependent upon many factors including compaction, soil type, moisture content and the like. The effective soil region 34 continues away from the corresponding helix 4 by a distance $D_{es}$ to an outer border 38. The distance $D_{es}$ to the outer border 38 varies depending upon the type of soil and the cohesion and friction characteristics thereof.

Each helix 4 experiences a force $F_{he}$ from a corresponding effective soil region 34 proximate thereto. The dimensions of each effective soil region 34 is somewhat different since the soil stiffness varies along the depth of the pier column 2. The dimensions of the effective soil region 34 also vary depending upon the diameter of the corresponding helix 4. Further, the effective soil region 34 for a given helix 4 is somewhat dependent upon the number, spacing, and diameter of the helixes 4 therebelow.

It should be noted that when a pier column is used in a tie-back application, the effective soil region is further limited by an "effective ceiling." The effective ceiling represents the uppermost level at which soil effectively serves to hold the anchor in the ground. Generally, the plane of the effective ceiling is located below the surface by a distance substantially equal to six times the diameter of the helix upon the pier column immediately there below.

When each helix 4 passes through a region of soil, the helix 4 agitates that soil thereby reducing its compaction level. This agitation creates voids 30 along side and loosens the soil in the region 32 adjacent the pier column 2. This agitation also reduces the skin friction, cohesion, and helix forces $F_{sf}$, $F_c$ and $F_{he}$, respectively, of the agitated soil. To minimize the reduction in these forces, the pier column 2 utilizes helixes 4 of varying size, in which the smallest helix 40 is near the bottom and the largest helix 42 is near the top. By using progressively larger helixes, the pier column 2 ensures that the load bearing surface of each helix partially contacts undisturbed soil (i.e., near the helix's outer perimeter). The contact between the outer perimeter of each helix 4 and the undisturbed soil ensures that the actual effective soil region 34 for each helix 4 more accurately coincides with the maximum effective soil region for the corresponding type of soil. To maximize the effective soil regions for a single pier column 2, the helixes 4 are spaced such that the outer border 38 for a corresponding helix 4 is located proximate the next helix 4.

The load bearing strata of an effective soil region 34 is dependent upon the soil type. Certain soils (such as gypsum and the like) include water soluble materials which strongly effect the soil's load bearing capacity (i.e., the helix force $F_{he}$ exerted by the soil upon the helixes). As water migrates along the outer surface of the pier column 2 and the helixes 4, in certain soils, the water soluble materials are broken down by the water leaving the resulting soil unstable. The outer surface of the pier column 2 serves as a conduit for surface water and directs same downward along a length of the pier column 2 and the helixes 4. The voids along the pier column 2 facilitate this water flow. The water is soaked into the soil surrounding the pier column 2, thereby influencing the soil load bearing capacity of certain types of soils. Thus, in certain types of soils the pier column 2 in and of itself may reduce its own effectiveness.

Underpinning Application

The pier column 2 of FIG. 1 is utilized as an underpinning for old and new construction. The underpinning 1 includes a pier column 2 having helical flighting 4 mounted thereon. The underpinning 1 is drilled into soil 6 to a desired depth. The pier column 2 includes a starter section 8 which may be a standard 2⅞" tubular hot-rolled steel section with a minimum yield of 35,000 psi. The starter section 8 may be 10½' longer or shorter in length and have at least one grade 50 hot-rolled helix plate of preselected diameter welded thereon. The starter section 8 includes a pointed lower tip 10. The pier column 2 may further include extension sections 12, each of which may be formed of a 2⅞" tubular hot-rolled steel pipe of approximately 10½' longer or shorter in length. The extension sections 12 are made of hot-rolled steel having a minimum desired yield strength, such as 50,000 psi, and a minimum desired tensile strength, for instance 60,000 psi. Each starter and extension section 8 and 12 is hollow and includes a plurality of pre-drilled holes 3, such as 9/16" in diameter, therein at desired intervals.

Optionally, each pier column 2 may include a helix insert section for higher load capacity projects. The helix insert may be formed of a standard 2⅞" tubular hot-rolled section with a minimum yield strength of 50,000 psi. The insert section may be any desired length, such as 10½', and include any desired number of helixes thereon, such as formed from grade 50 hot-rolled helix plates of preselected diameter.

The starter, insert, and extension sections are connected to one another through connectors 14 which are tubular in shape and have an outer diameter just slightly smaller than the inner diameter of each pier section. By way of example, the connector 14 may be formed 10" in length and with a 2¼" outer diameter and 0.375" wall thickness. Multiple bolt holes 16 are pre-drilled in each connector 14 and aligned with corresponding bolt holes 18 in adjoining ends of each pier section. Bolts, such as continuously threaded hex head caps having a diameter of ¾ and grade 8 steel are received through the corresponding bolt holes 16 and 18 to secure aligning pier sections to the connector 14. The diameter of the bolts 20 is relatively small in comparison with the inner diameter of the connector 14, in order that grouting may easily pass thereby as explained below.

Figure 3:
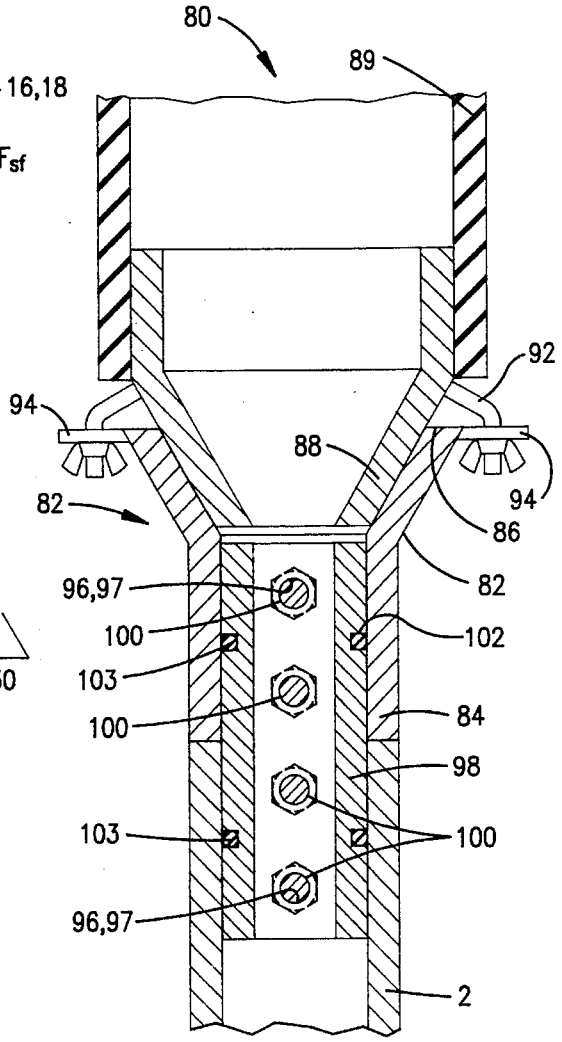
FIG. 3 illustrates a side sectional view of a grout injection apparatus connected to the top of an anchor.

FIG. 3 illustrates a grout injecting apparatus 80 which is securely mounted to the upper end of the pier column 2 once it has been driven to a desired depth. The grout injecting apparatus 80 includes a grouting adaptor 82 having a lower end 84 which is tubular in shape and substantially resembles the shape of each pier section. The tubular lower end 84 abuts against the upper end of the pier column 2. The adaptor 82 includes an upper end 86 which is funnel-shaped to receive a cone-shaped injector 88. The cone-shaped injector 88 is securely mounted on the end of an injection hose which delivers grout from a remotely located grout pump (not shown) through a hose 89. The cone-shaped injector 88 includes fastening members 92 which securely fasten the injector 88 to the funnel-shaped upper end 86 of the adaptor 82.

The fastening members 92 releasably attach to support members 94 formed on the adaptor 82. As wing nuts on the fastening members 92 are tightened, they draw the injector 88 downward into the funnel-shaped upper end 86 of the adaptor 82 to effect a sealed relation therebetween. The inner periphery of the upper end 86 of the adaptor 82 is formed with substantially the same angle as the outer periphery of the cone-shaped injector 88 to ensure a proper seal therebetween. Optionally, an O-ring may be inserted between the injector 88 and the funnel shaped upper end 86 to effect a sealing relation therebetween.

The lower end 84 of the adaptor 82 includes holes 96 directed radially outward through opposite sides thereof. The holes 96 align with corresponding holes 97 in a connector 98. The holes within the adaptor 82, connector 98 and pier column 2 receive bolts 100 to fasten securely the adaptor 82 to the pier column 2. The connector 98 is formed with an outer diameter slightly smaller than the inner diameter of the adaptor 82 and of the pier column 2. The bolts 100 are formed with a significantly smaller diameter than that of the inner recess through the connector 98 to enable grout to pass thereby. The connector 98 further includes grooved recesses about its perimeter proximate opposite ends thereof.

As illustrated in FIG. 3, grooved recesses 102 are located between corresponding sets of bolt holes 100 used to connect the adaptor 82 and the pier column 2. The grooved recesses 102 receive circular resilient sealing materials, such as O-rings 103, which extend about the periphery of the connector 98 to ensure a sealed connection between the connector 98 and the adaptor 82 and pier column 2. Optionally, inner surfaces of the pier column 2 and the lower end 84 of the adaptor 82 may also include corresponding grooved recesses 102 to receive the O-rings 103 to further enhance the sealing effect.

Once the pier column 2 has been sunk into the ground and the grouting has been injected therein, a bracket may be secured thereto in order to tie the pier column 2 to the corresponding structure. This bracket may take a variety of forms, depending upon the application to be utilized by the pier column. For instance, with new construction, a cap plate 22 (FIG. 2) is inserted over the top of the pier column 2 and the foundation is poured such that the cap plate 22 is embedded therein. The cap plate 22 includes a tubular bottom housing 24 which has a hollow bottom portion with an inner diameter greater than an outer diameter of the pier column 2. The hollow bottom receives the top of the pier column 2. The hollow bottom abuts against and is secured to a flat base plate 26. The base plate 26 supports C-shaped field stirrups 28 extending upward and outward therefrom. the stirrups 28 are constructed of reinforcing bars similar to the bars used throughout the foundation to provide support therefore. Alternatively, the field stirrups 28 may be formed of steel brackets, such as from an I-beam or the like. The field stirrups 28 are ultimately embedded in the foundation.

Alternatively, the pier column 2 may be used to support an existing structure and hence may be secured to a bracket to couple the foundation of the existing structure to the pier column 2. By way of example, these brackets may be of the type disclosed in U.S. Pat. Nos. 4,634,319, 4,800,700, 4,854,782, 5,011,336, 5,120,163, 5,139,368, 5,171,107, and 5,213,448 (incorporated herein by reference). As these brackets are disclosed in detail in the above-noted patents, a detailed description thereof is omitted herefrom.

During installation, a torque motor is attached to the upper end the starter section 8 and used to rotatably install it into the ground. Additional insert and extension sections may be added and rotatably installed as necessary. The pier column 2 is sunk until a required design resistance torque is achieved or a predetermined depth is reached. The shaft of the final extension section 12 is cut off to a desired elevation with respect to the foundation.

Once the pier column 2 is rotated to the desired depth, the torque motor is detached and the grout injection apparatus 80 is connected to the uppermost end of the extension section 12. More specifically, the hollow adaptor 82 is bolted to the upper end of the pier column 2 through the connector 98. A sealing relation is maintained therebetween by the O-rings 103. Next, the cone-shaped injector 88 is inserted into the funnel-shaped upper end 86 of the adaptor 82. The fastening members 92 are secured to the support members 94 in order to draw the injector 88 into the adaptor 82 in a sealed relation. Next, the grout pump is activated and grouting is injected through the adaptor 82 into the hollow pier column 2 and out through the perforated holes 30 along the pier column 2. The grouting is injected under a substantial pressure and hence, fills the voids 30 (FIG. 1) which surrounded the pier column 2.

Figure 2:
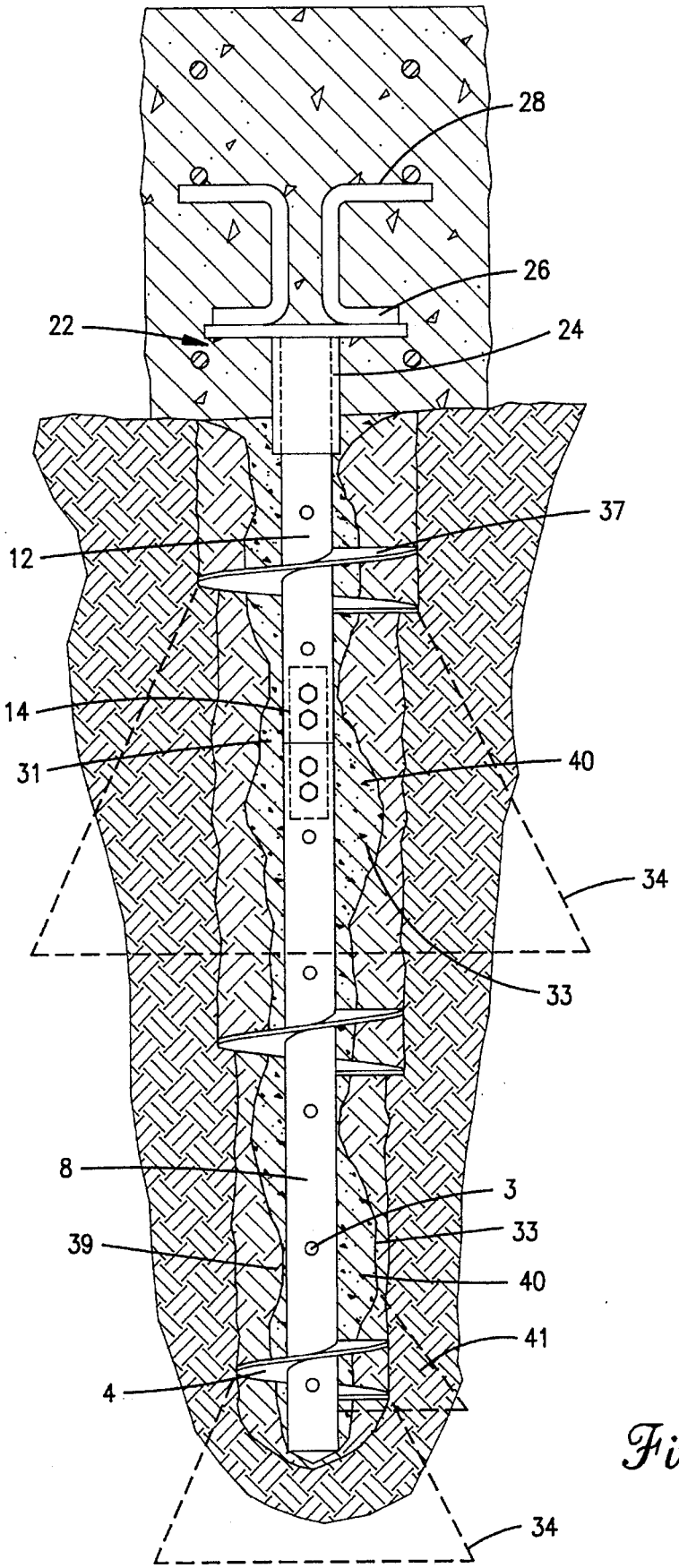
FIG. 2 illustrates a side sectional view of the helical anchor of FIG. 1 with grout injected therein and out through the perforated holes in a periphery of the anchor.

As illustrated in FIG. 2, the grouting 31 flows in a somewhat non-uniform manner primarily dictated by the consistency of, and voids within, the soil. Regions such as 40 having loose soil therein receive a significant amount of grout to form a nodule on the side of the pier column 2. As the grout is ejected from the holes 3, the soil is intermixed therewith and displaced in a compacting fashion laterally outward from the pier column 2. This lateral displacement stiffens the soil, thereby increasing the soil's cohesion and friction characteristics. Thus, as the grout fills the region 33, it simultaneously expands the effective soil region 34 proximate each helix 37.

As illustrated in FIG. 2 at point 39 along the pier column 2, the grout may achieve a substantially minor amount of soil displacement. This is due to the fact that the soil adjacent point 39 is initially stiff and exhibits significant cohesion and friction characteristics in comparison to those of the surrounding soils (e.g., region 40). As the soils at point 39 already exhibit good stiffness characteristics, a lack of grout at point 39 is not necessarily detrimental since grout is not needed to improve the soils' stiffness. However, in contrast, the soil at region 40 was less stiff and potentially included a void which was filled by grout. Further, the grout region 40 projects outward from the pier column 2 to such a significant degree that it also includes a corresponding effective soil region 41. The effective soil region 41 operates upon the grouting module 40 in the same manner as the effective soil region 34 described above with respect to the helixes 4.

Tie-Back Application

Figure 4:
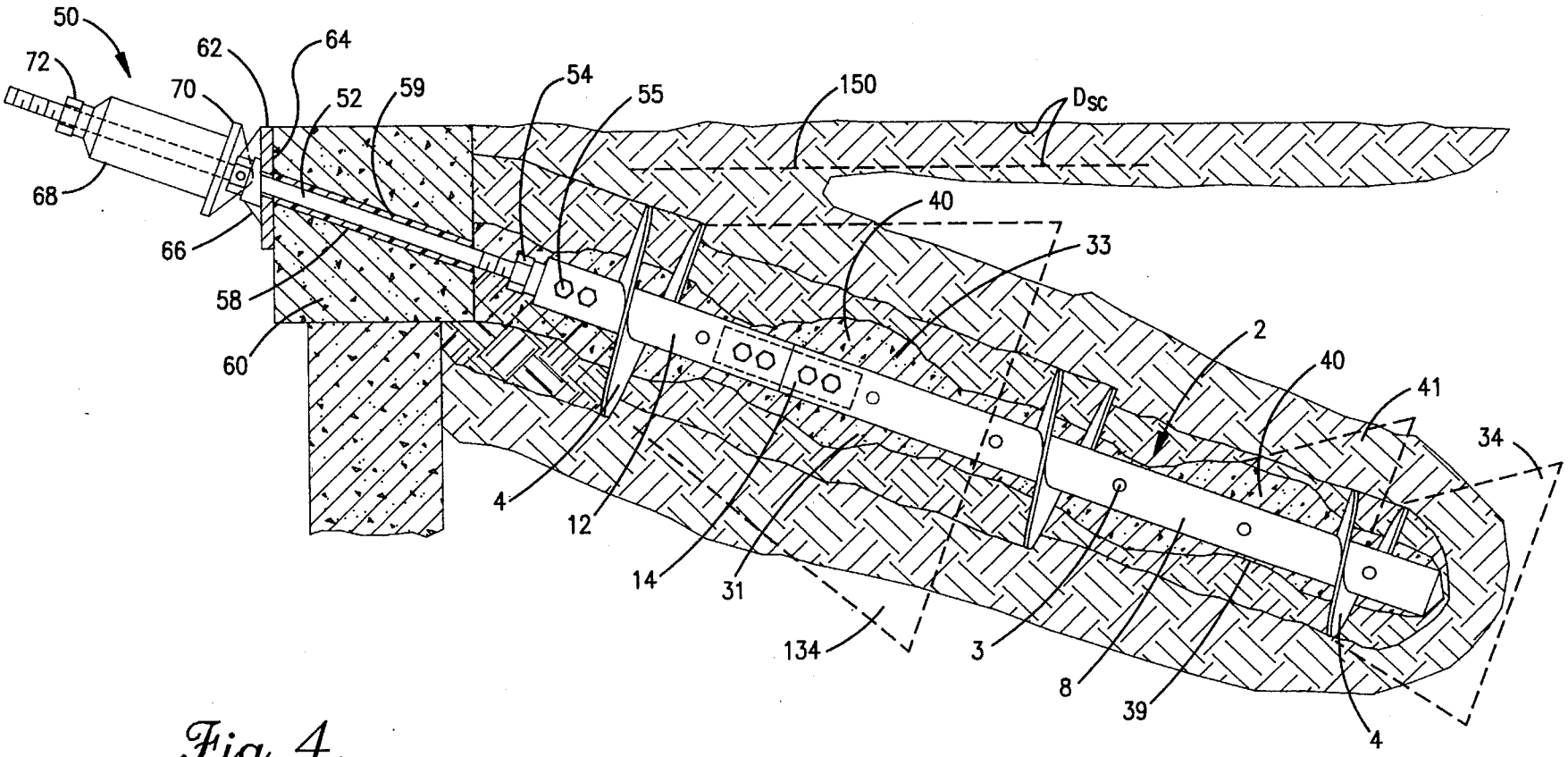
FIG. 4 illustrates a side sectional view of a helical anchor used in a tie-back application.

Alternatively, the present pier column 2 may be utilized in a tie-back application such as illustrated in FIG. 4.

FIG. 4 illustrates a pier column 2 having a starter section 8 and an extension section 12, coupled to one another with a connector 14. The pier column 2 substantially resembles that of FIG. 1, and thus is not described in detail. However, divergent from FIG. 1, the pier column 2 of FIG. 4 is used in a tie-back application. Thus, the pier column 2 is oriented in a non-vertical direction. Also, the upper end of pier column 2 is fastened to a lower end of a coupler 54 through bolts and holes 55. The coupler 54 is threadably secured to one end of a lag bar 52. The lag bar 52 projects through a bore hole 58 in the structure 60 to be retained and at an angle corresponding to the angle at which the pier column 2 is oriented. A reaction plate 62 includes a hole therethrough to receive the lag bar 52. The reaction plate includes an inner surface 64 constructed to smoothly abut against the outer surface of the structure 60. The reaction plate 62 includes an angled bracket 66 mounted on an outer surface thereof. The bracket 66 rotatably supports a tubular cap sleeve 68. The cap sleeve 68 includes an angled bracket on a lower end thereof which is rotatably mounted on the bracket 66. The cap sleeve 68 includes a bore hole therethrough and along a longitudinal axis thereof to slidably receive the lag bar 52. The lag bar 52 projects from an outer surface of the cap sleeve 68 and includes a hex lag nut 72 thereon.

The bore hole 58 is lined with a resilient liner 59 to fill in any voids between the lag bar 52 and the bore hole 59. During operation, the lag nut 72 is threaded onto the lag bar 52 thereby forcing the cap sleeve 68 inward toward the retaining structure 60. In this manner, the reaction plate 62 retains the structure 60 in a desired position as anchored by the tie-back pier column.

During operation, a torque motor is attached to the starter section 8 and the helical tie-back anchor is rotatably installed. As noted above, additional extension sections 12 are added through connectors 14 until a desired depth is reached. Thereafter, the torque motor is removed and the grout injecting apparatus 80 is installed. Next, pressurized grout is forced into the hollow pier column 2 and out through the perforated holes therein. This grout forms nodules about the pier column (as illustrated in FIG. 4). Once the grout is injected, the injecting apparatus 80 is removed and the lag bar 52 is installed. The cap sleeve 68 is tightened upon the lag bar 52 until a desired amount of tie-back tension is applied to the structure.

The soil interacts with the helixes 4 and the grout nodules along the pier column 2 in substantially the same manner as described above with respect to the underpinning application. However, the effective soil region 134 surrounding each helix 4 or nodule may not extend above a support ceiling 150 which is a distance $D_{sc}$ below the surface. The distance $D_{sc}$ is approximately six times the diameter of the helix 4 or grout nodule immediately therebelow. Soil above the support ceiling is not provide a significant anchoring force in a tie-back application.

If an existing structure is to be tied-back, the soil is excavated immediately adjacent the backside of the structure to a depth slightly below the level corresponding to the level at which the pier column 2 is to inserted. A core hole is drilled through the structure and the shaft of a torque motor is inserted there through. A starter section is positioned at the desired point and angle within the excavated region outside the structure proximate the core hole. If the starter section is to short to extend from the soil drill point to the core hole, the pier column may be extended. To do so, couplers and extender sections are mounted on the starter section until the outer end of the extender section is located proximate the core hole. The drill shaft is secured to the extender section and the torque motor is used to drill the pier column into the soil. As necessary, extender sections are added until the pier column is sunk to the desired depth.

The overall grouting regions surrounding the pier column 2 includes a substantially larger surface area than that of the pier column 2. Thus, the skin friction and cohesion forces $F_{sf}$ and $F_c$ are increased. Further, the surface of the outer perimeter of the grout is significantly rougher than that of the pier column 2. This increased roughness further increases the skin friction and cohesion forces.

Moreover, the rough texture along the perimeter of the grouting, as it interacts with the surrounding soil, discourages the flow of rainwater therealong. Instead, the rain water tends to dissipate near ground level into the soil. Thus, the rainwater does not migrate notably along a length of the grout covered pier column 2, nor along the helixes 4. Therefore, the grouting minimizes the detrimental effects of rainwater upon soil's helix, the cohesion and friction forces $F_{he}$, $F_{sf}$ and $F_e$, respectively, for soils sensitive to rainwater.

As noted above, the grouting increases the effective surface area of the pier column which increases the lateral forces exerted upon the pier column. This increase in lateral forces provides additional support for the pier column and prevents deflection thereof. The grouting further fills the voids adjacent the pier column which previously allowed such deflection. By preventing deflection and by increasing the effective cross-section of the pier column, a pier column having a small diameter is able to support a load substantially greater than in the past. For instance, experimentation has shown that a pier column which utilizes injection grouting and has a diameter of 2¼" is capable of supporting a load applied to a pier column which does not utilize injection grouting but has a diameter of 10".

Optionally, pier column sections may be used having a concentrated group of perforated holes therein to be located near a layer of soil which has been determined to be quite weak from soil testing.

Optionally, pier columns from the foregoing embodiments may be combined in a single application, for instance in hill side applications.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A method for installing a pier column, having a hollow body with perforations along a length thereof, which is affixed to a structure to support said structure, said pier column interacting with a surrounding effective soil region to resist lateral and longitudinal movement by said structure, said method comprising the steps of:

rotating said pier column into the soil to a predetermined depth and halting rotation of said pier column thereafter, after halting rotation of said pier column, pumping pressurized grout through an upper end of the pier column, along said hollow body, and out through said perforated holes to fill any voids in soil surrounding said pier column, forming grout nodules securely fixed to and arranged about an exterior surface of said pier column, and securing said pier column to said structure.

2. A method for installing a pier column, according to claim 1, further comprising the step of including at least one helix upon an outer periphery of said pier column.

3. A method for installing a pier column, according to claim 1, further comprising the step of increasing a stiffness characteristic of said soil surrounding said pier column to a desired level of support for said pier column by continuously pumping said grout from said perforated holes after halting rotation of said pier column.

4. A method for installing a pier column, according to claim 1, further comprising the step of arranging said perforated holes unevenly along a length of said pier column to locate a majority of said perforated holes proximate layers of soil along said pier column that exhibit weak anchoring characteristics relative to other layers of soil along said pier column.

5. A method for installing a pier column, according to claim 1, further comprising the step of arranging said perforated holes unevenly along a length of said pier column to locate a majority of said perforated holes proximate regions of soil having a largest number of voids therein along said pier column.

6. A method for installing a pier column, according to claim 1, further comprising the step of testing said soil, before rotating said pier column therein, to evaluate the anchoring characteristics.

7. A method for installing a pier column, according to claim 1, further comprising the step of securing said upper end of said pier column to a structure such that said pier column serves as a tie-back anchor.

8. A method for installing a pier column, according to claim 1, further comprising the step of securing said upper end of said pier column to a structure such that said pier column serves as an underpinning for said structure.

9. A method for installing a pier column, according to claim 1, further comprising the steps of:

fastening a bracket to said pier column, lifting an existing structure to a desired height, securing said structure, through said bracket, to pier column at said desired height.

10. A method for installing a pier column, according to claim 1, further comprising the steps of:

fastening a bracket to said pier column, said bracket include field stirrups on an upper end thereof, pouring a foundation of a structure to be supported with said field stirrups embedded within said foundation.

11. A method for installing a pier column, according to claim 1, further comprising the step of preventing migration of liquid along said pier column by forming nodules of grout from said perforated holes along said pier column.

12. A method according to claim 1, further comprising the step of minimizing agitation of soil proximate the pier column by immediately ceasing rotation of the pier column upon reaching the predetermined depth.

13. A method according to claim 1, further comprising the step of providing at least two helixes on the pier column spaced apart from one another by a distance at least equal to a height of the effective soil region corresponding to one helix.

14. A method according to claim 1, further comprising the step of ceasing rotation of the pier column immediately after the pier column experiences a predetermined amount of resistance torque.

15. A method according to claim 1, further comprising the step of providing at least two helixes mounted on the pier column, said helixes having different diameters from one another.

16. An apparatus for installing a pier column which is affixed to a structure to anchor and support said structure, said pier column interacting with a surrounding effective soil region to resist movement by said structure in any direction, said apparatus comprising:

a pier column having an upper end and a hollow body with perforations along a length thereof;

driving means, detachably engaged with said upper end of said pier column, for rotatably driving said pier column into the soil to a predetermined depth, wherein said driving means is detached from engagement with said pier column when said column is driven to said predetermined depth;

grout pumping means, detachably connected to said upper end of the pier column after detachment of said driving means, for pumping grout through said upper end, along said hollow body, and out through said perforated holes, said grout forming grout nodules securely fixed to and arranged about an exterior surface of said pier column, and a bracket for securing said pier column to said structure.

17. An apparatus for installing a pier column, according to claim 16, wherein said pier column includes at least one helix upon an outer periphery thereof, said driving means rotating said pier column to cause said helix to pull said pier column into the soil.

18. An apparatus for installing a pier column, according to claim 16, wherein said grout is continuously pumped from said perforated holes until said exterior of said pier column is substantially covered.

19. An apparatus for installing a pier column, according to claim 16, wherein said grout increases a stiffness characteristic of said soil surrounding said pier column to provide a desired amount of support for said pier column by continuously pumping said grout from said perforated holes under a predetermined pressure.

20. An apparatus for installing a pier column, according to claim 16, wherein said perforated holes are arranged unevenly along a length of said pier column to locate a majority of said perforated holes proximate layers of soil along said pier column that exhibit weak anchoring characteristics relative to other layers of soil along said pier column.

21. An apparatus for installing a pier column, according to claim 16, wherein said perforated holes are arranged unevenly along a length of said pier column to locate a majority of said perforated holes are proximate regions of soil having the largest number of voids therein along said pier column.

22. An apparatus for installing a pier column, according to claim 16, wherein said pier column is secured to, and supports, a structure as a tie-back anchor.

23. An apparatus for installing a pier column, according to claim 16, wherein said pier column is secured to, and supports, new and existing structures as an underpinning therefor.

24. An apparatus for installing a pier column, according to claim 16, wherein said pier column lifts and supports an existing structure, said apparatus further comprising:

a bracket fastened to said pier column, means, secured to said bracket, for lifting said existing structure to a desired height, means for securing said structure, through said bracket, to pier column at said desired height.

25. An apparatus for installing a pier column, according to claim 16, further comprising:

bracket having a lower end fastened to said pier column and an upper end including field stirrups embedded within a foundation of a new structure such that said pier column serves as an underpinning for said new structure.

26. An apparatus for installing a pier column, according to claim 16, further comprising means for preventing migration of liquid along said pier column by forming nodules of grout from said perforated holes along said pier column.

27. An apparatus according to claim 16, further comprising at least two helixes mounted upon said pier column, said helixes being spaced apart by a distance at least equal to a height of the effective soil region corresponding to one helix.

28. An apparatus according to claim 16, wherein said driving means ceases rotation of the pier column immediately after the pier column experiences a predetermined amount of resistance torque.

29. An apparatus according to claim 16, further comprising at least two helixes mounted on said pier column, said helixes having different diameters from one another.

* * * * *